United States Patent [19]

Hernandez

[11] Patent Number: 4,483,119

[45] Date of Patent: Nov. 20, 1984

[54] BAR SUPPORT FOR USE WITH REINFORCED CONCRETE

[76] Inventor: Ernest Hernandez, 1237 Thackery, West Covina, Calif. 91790

[21] Appl. No.: 507,700

[22] Filed: Jun. 23, 1983

Related U.S. Application Data

[63] Continuation of Ser. No. 249,871, Apr. 1, 1981, abandoned.

[51] Int. Cl.[3] ..... E04C 5/20

[52] U.S. Cl. ..... 52/689

[58] Field of Search ..... 52/677–689

[56] References Cited

U.S. PATENT DOCUMENTS

| | | | |
|---|---|---|---|
| 1,260,494 | 3/1918 | Widmer | 52/689 |
| 1,275,430 | 8/1918 | Hough | 52/684 |
| 1,651,946 | 12/1927 | Burrell | 52/684 |
| 1,726,496 | 8/1929 | Kinninger | 52/677 |
| 1,767,575 | 6/1930 | Bujack | 52/677 |
| 3,191,345 | 6/1965 | Schwachula | 52/689 |
| 3,430,407 | 3/1969 | Berry | 52/689 |
| 3,471,987 | 10/1969 | Yelsma | 52/684 |
| 3,689,051 | 9/1972 | Miller | 249/131 |
| 3,927,624 | 12/1975 | Hewson | 52/668 |
| 4,060,954 | 12/1977 | Liuzza | 52/677 |

FOREIGN PATENT DOCUMENTS

| | | | |
|---|---|---|---|
| 227969 | 11/1959 | Australia | 52/689 |
| 49529 | 4/1982 | European Pat. Off. | 52/677 |
| 371839 | 4/1932 | United Kingdom | 52/686 |
| 1068906 | 5/1967 | United Kingdom | 52/689 |

*Primary Examiner*—J. Karl Bell

*Attorney, Agent, or Firm*—Boniard I. Brown

[57] ABSTRACT

A support for use with an associated reinforcing rod, which is intended for reinforcement of concrete, which includes first and second generally planar members. The first member has a body portion, a first elongated leg and a second elongated leg. The first and second elongated legs extend from the body portion in mutually diverging relationship. The body portion has an edge opposite to a side from which the first and second legs extend which is substantially rectilinear. The second member has a body portion, a first elongated leg and a second elongated leg. The first and second elongated legs extend from the body portion in mutually diverging relationship. The body portion has an edge opposite to a side from which the first and second legs extend which has upstanding extremities to constrain movement of an associated reinforcement rod. The body portions define interengaging slots for fixing the first and second generally planar members in substantially normal relationship.

12 Claims, 10 Drawing Figures

BAR SUPPORT FOR USE WITH REINFORCED CONCRETE

This is a continuation of copending application Ser. No. 249,871 filed Apr. 1, 1981, now abandoned.

BACKGROUND OF THE INVENTION

The apparatus in accordance with the invention relates to building construction apparatus and particularly to apparatus used in forming reinforced concrete members or slabs, and to supports for positioning a reinforcement bar while concrete is poured around it and then allowed to set. More particularly, it has special application to structures which are sometimes referred to as "chairs" for supporting reinforcement bars during the fabrication of reinforced concrete panels, slabs, or walls. The reinforced concrete panel being formed is separated from the floor or supporting surface by "spray sealing" or by a form liner. Such form liners are typically made of polystyrene and are contoured to produce a decorative effect on the formed concrete surface. Such decorative effects may include surfaces resembling a brick wall, a stone wall, logs or other aesthetically desirable contours. Form liners of this general type are manufactured by Labrado Form Liner Company, of Laguna Hills, Calif. The chairs remain within the cast concrete with the axial extremities or feet thereof extending out of the cast concrete toward the cooperating form liner.

Various apparatus including wire structures have been provided. Such structures have not been wholly satisfactory because the support was unstable, or left an unsightly appearance on the finished product. Some structures which have been known heretofore have been unsatisfactory because of the difficulty of breaking off the feet of the support apparatus which extend through the face of the finished product and create an unsightly appearance if not properly severed. Some support structures have been unsatisfactory because of bleeding and particularly rusting which discolors the concrete adjacent to the support. The latter problem is most acute with metal supports which had been chiseled or broken off so that there is no rust inhibiting coating, such as zinc, in the area that is broken off.

Another problem with the known supports is that frequently they are relatively bulky to ship as well as to carry to the work site. Still another problem with known apparatus is that they are vulnerable to producing voids in the cast concrete which substantially weakens the concrete and compromises the structural integrity of structures manufactured with such supports.

It is an object of the invention to provide apparatus which is collapsible for easy shipment.

It is another object of the invention to provide apparatus which provides a very stable support for an associated reinforcing rod, despite the destabilizing effects of concrete pouring over the reinforcing rod and the supports therefor.

It is another object of the invention to provide apparatus which will be contoured in a manner which will minimize the formation of voids in the cast concrete which would compromise the physical characteristics thereof.

Another object of the invention is to provide apparatus which not only will be stronger than known apparatus, but will also enable the user to easily break off the feet thereof, after setting of the concrete, to produce an aesthetically satisfying appearance.

Still another object of the invention is to provide apparatus which is simple and inexpensive to manufacture and which will reduce the time to form cast concrete structures and thereby reduce the total construction cost.

SUMMARY OF THE INVENTION

The foregoing objects and other objects and advantages which shall become apparent from the detailed description of the preferred embodiment are attained in an apparatus which includes a support for use with an associated reinforcing rod, which is intended for reinforcement of concrete, which includes a first and second generally planar members. The first member has a body portion, a first elongated leg and a second elongated leg. The first and second elongated legs extend from the body portion in mutually diverging relationship. The body portion has an edge opposite to a side from which the first and second legs extend which is substantially rectilinear. The second member has a body portion, a first elongated leg and a second elongated leg. The first and second elongated legs extend from the body portion in mutually diverging relationship. The body portion has an edge opposite to a side from which the first and second legs extend which has upstanding extremities to constrain movement of an associated reinforcement rod. The body portions define interengaging slots for fixing the first and second generally planar members in substantially normal relationship.

In some forms of the invention a slot may be provided in each body portion through which an imaginary plane may extend which bisects an angle defined by the axes of the first and second elongated legs of the second generally planar member. One of the slots may extend, in one of the first and second body portions, proximate to a point intermediate the intersection of the elongated legs and the body portion. One of the slots may extend, in the other of the first and second generally planar members, from the edge thereof remote from the side from which the elongated legs diverge. The legs may each include a rib extending along the inside edge thereof. The axial extremity of each rib most remote from the body portion, on any given member, may be spaced from the axial extremity of the associated leg which is most remote from the body portion. The distance intermediate the axial extremities of the legs of the second member, remote from the body portion may be greater than the distance intermediate the upstanding extremities. The distance intermediate the axial extremities of the legs of the first member, remote from the body portion may be equal to the distance intermediate the axial extremities of the legs, of the second member. The generally planar members may be each manufactured of a plastic. The plastic may be gray.

BRIEF DESCRIPTION OF THE ACCOMPANYING DRAWING

DESCRIPTION OF THE PREFERRED EMBODIMENT

Figure 1:
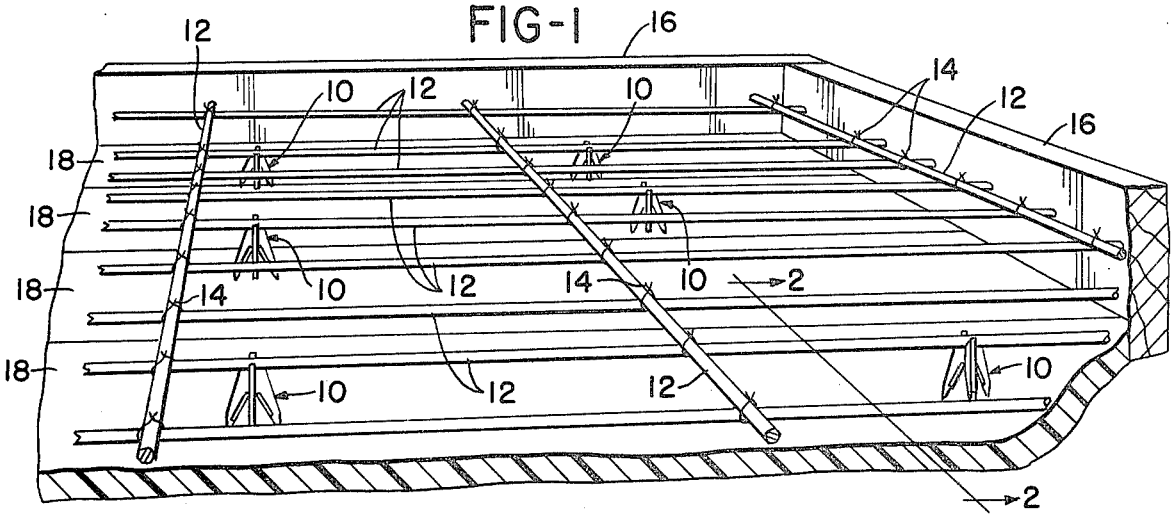
FIG. 1 is a partial perspective view illustrating the manner of use the chairs or supports in accordance with the invention with associated reinforcement rods and concrete forms.
Figure 2:
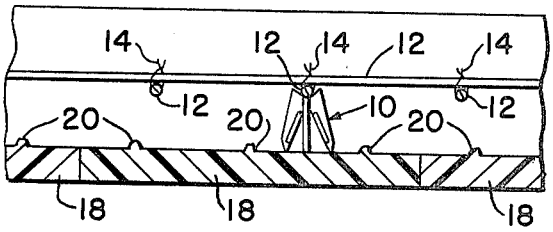
FIG. 2 is a partial sectional view taken along the line 2—2 of FIG. 1.

Referring now to FIGS. 1 and 2 there is shown the general manner in which the apparatus in accordance with the invention is utilized. The supports 10 in accordance with the invention cooperates with reinforcing bars 12 which are disposed in a grid arrangement. The intersections of the reinforcing bars 12 are tied by wires 14 to stabilize the relative positions.

The reinforcing bars 12 are surrounded by outside forms 16 (two shown). Disposed immediately under the supports 10 are the form liners 18. The form liner 18 typically comprises elongated planar sections which are provided with a design. As seen in FIG. 2, the illustrated structure includes a plurality of generally parallel ribs 20 which are intended to simulate the appearance, in the cast concrete, of clapboards.

Referring now to FIGS. 3-8, there is shown in greater detail the support 10 in accordance with the invention. The support 10 includes first and second generally planar members which are respectively identified by the numerals 25 and 24. The second generally planar member 24 has a body portion 26 from which diverging legs 30, 32 extend. The body portion 26 includes upstanding axial extremities 34, 34 which engage the associated reinforcing rod 12 to limit lateral movement. To insure that the support 10 provide a stable mounting, the axial extremities or feet 36 of the legs 30, 32 are spaced apart a distance which is greater than the spacing intermediate the axial extremities 34, 34. To further increase the resistance to shock and general stability of the support 10, ribs 38 are positioned on at least one face of the generally planar member 24. In the illustrated embodiment, ribs 38 are positioned on the inside edge of each leg 30, 32 on each side of generally planar member 24. It will be observed that the lower (as viewed) extremity of the ribs 38 does not extend to the extremity of the legs 30, 32. As will be described hereinafter, this is intentional and is intended to insure that the feet 36, 36 may be easily broken off after the concrete has hardened. Ribs 39 are provided along the inside edges of the slot 27 to provide reinforcement and to more positively lock the elements 24 and 25 together. The ribs 39 preferably extend to the lower extremity of the body portion 26. In other words, the ribs extend from the top to the bottom of the body portion 26. More particularly, the reinforcement avoids cracking of the extremities 34.

Figure 7:
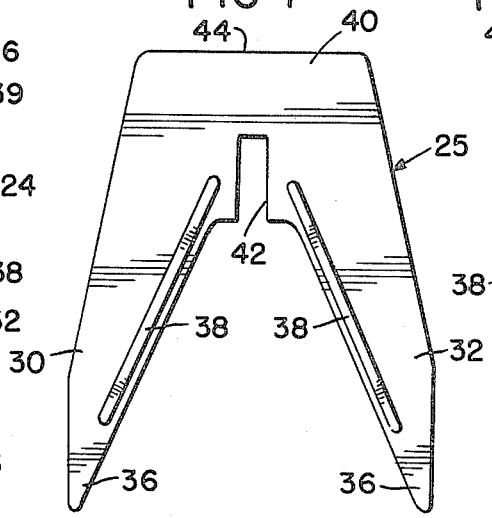
FIGS. 7 and 8 are respectively front and side elevational views of the other member of the support illustrated in FIGS. 1-3.
Figure 8:
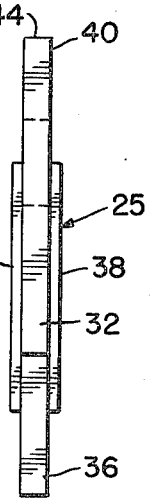

Referring now to FIGS. 7 and 8, the first generally planar member 25 is illustrated, which in certain respects is generally similar to the second generally planar member 24. Similarities include the structure, angular orientation and length of the legs 30, 32. These legs 30, 32 are also reinforced with ribs 38, 38 on each face of the generally planar member 25. The axial extent of the ribs 38 is normally the same as the ribs on the second generally planar member 24. The body portion 40 differs in that a slot 42 extends from the side thereof, which is intermediate the juncture with the legs 30, 32. The opposite, or upper, side 44 of the body portion 40 is flat or rectilinear. This contour is preferable since it provides a stable support for the associated reinforcing rod 12, as best illustrated in FIG. 3.

Figure 3:
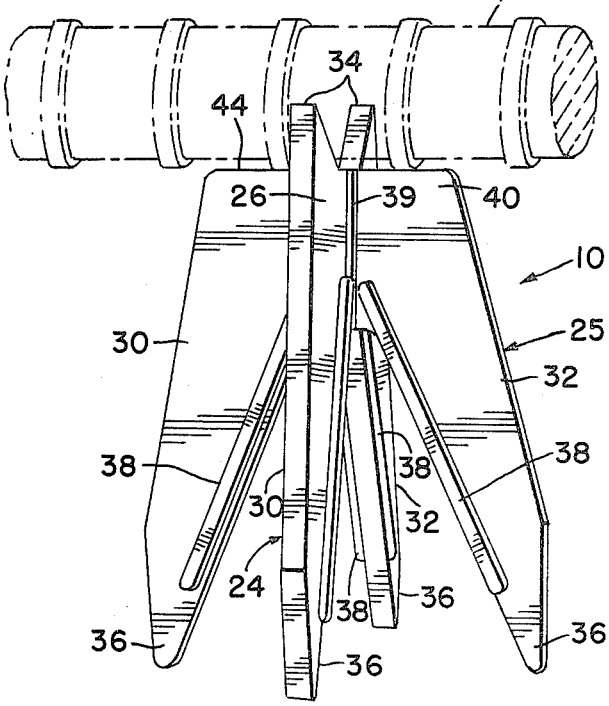
FIG. 3 is a partial perspective view of a portion of the apparatus illustrated in FIG. 1, which shows the details of the construction of the support in accordance with the invention and the manner of cooperation with an associated reinforcement rod.
Figure 4:
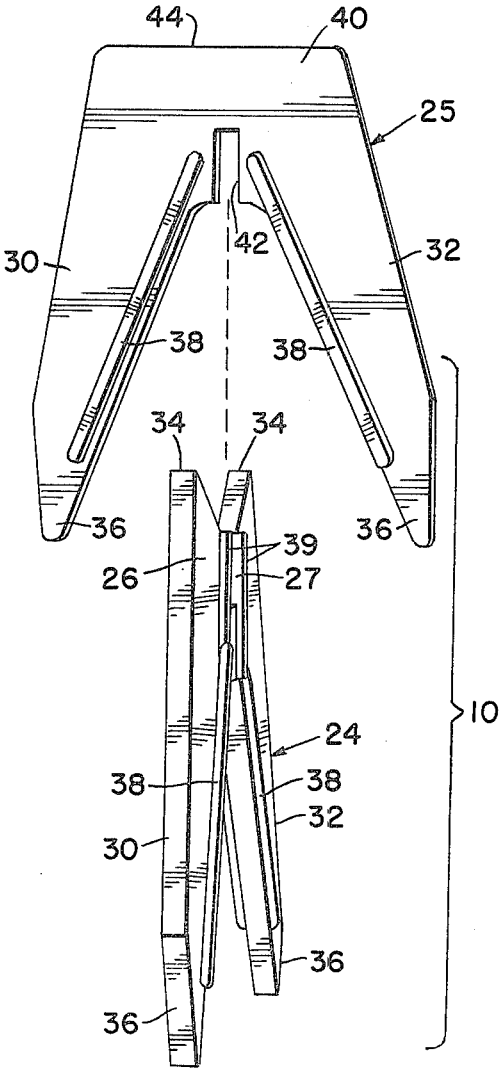
FIG. 4 is an exploded view of the support in accordance with the invention.
Figure 5:
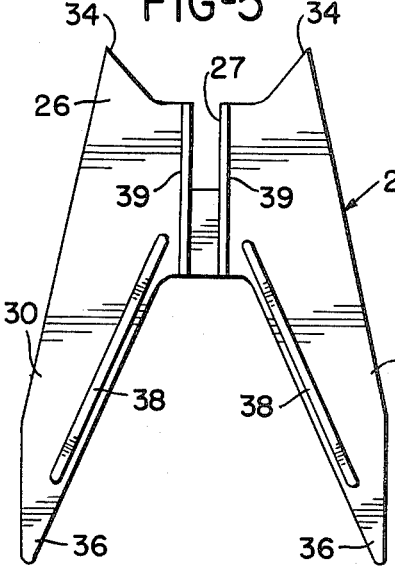
FIGS. 5 and 6 are respectfully front and side elevational views of one member of the support illustrated in FIGS. 1-3.
Figure 6:
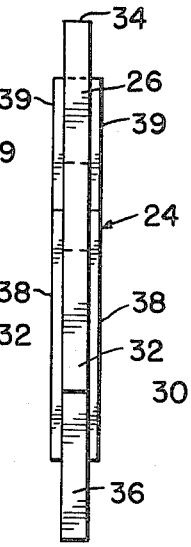

The slots 27, 42 cooperate to firmly lock the first and second generally planar members 25, 24 in engagement as best illustrated in FIGS. 3 and 4.

Figure 9:
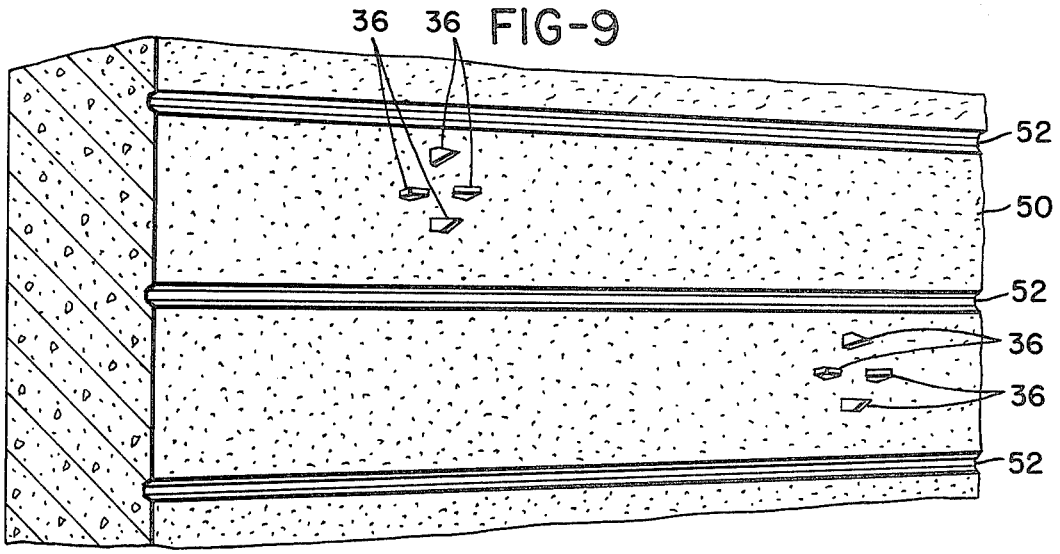
FIG. 9 is a perspective view illustrating the surface of concrete which has been molded by a form liner and which, more particularly, shows the feet of the supports or chairs extending through the molded face of the concrete.
Figure 10:
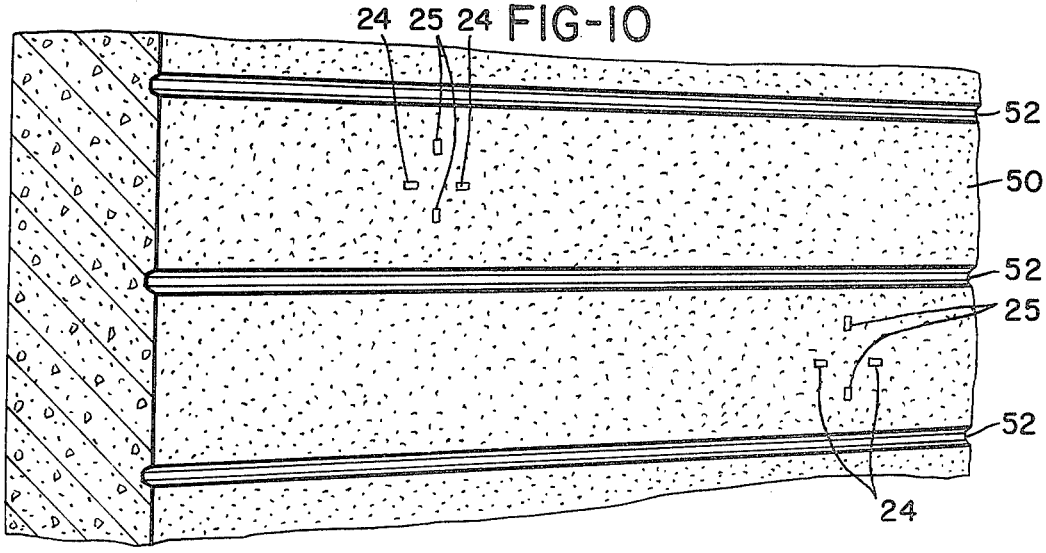
FIG. 10 is a view similar to FIG. 9 showing the general appearance of the structure after removal of the feet illustrated in FIG. 9.

Referring now to FIGS. 9 and 10, there is shown a section 50 of cast concrete which has been formed by the form liners 18. The section 50 includes a plurality of grooves 52 formed by the ribs 20. Extending through the face of the section 50 are a plurality of feet 36. It will be understood that the feet 36 are disposed in abutting relationship with the form liner 18. As illustrated in FIG. 2, it is normal for the dry or cured concrete to not completely cover the feet 36. The support 10 advantageously has the rib 38 extending only part of the way down each of the legs 30, 32 so that the feet 36 may be easily removed with a chisel, hammer or other instrument. As best seen in FIG. 10, the feet 36 easily break off to be substantially flush with the face of the section 50 so that an aesthetically attractive appearance is possible. It will be understood that the support 10 is typically manufactured of a gray plastic having a color which is substantially the same as the color of the concrete from which the section 50 is manufactured. For applications using white or colored concrete other pigments may be utilized when forming the supports 10.

The dimensions of the apparatus in accordance with the invention will vary with the particular application. For example, with different wall thicknesses the height of the reinforcing rod 12 with respect to the form liner 18 will vary. In one typical form the height of the generally planar member 24 will be 4 5/16 inches high and have a distance of 3 inches intermediate the feet 36. The cooperating generally planar member 25 will have a height of 4 inches and distance between the feet 36 of 3 inches. In another embodiment, the respective dimensions of the generally planar member 24, the distance intermediate the feet 36, and the height of the generally planar member 25 are respectively: (a) 3 13/16", 2½", 3½". In other embodiments, the height of the generally planar member 25 will be respectively between 4 inches and ¾ inches.

It will thus be seen that the apparatus in accordance with the invention has various important advantages, in that the legs 30, 32 extend outwardly so that there is less vulnerability to wobbling or tilting under a load. In addition, the legs 30, 32 are configured to provide a relatively large intermediate space so that there is less tendency to hinder the flow of poured concrete intermediate the legs 30, 32 and thus result in a void which would weaken the hardened concrete. The two piece structure has important advantages in that the individual sections may be shipped in stacks which are very compact. The rib construction has the benefit of providing improved strength and rigidity, while simultaneously facilitating the breaking off of the feet 36. In addition, the apparatus in accordance with the invention has the still further advantage that the structure may be manufactured relatively inexpensively and, more importantly, at less cost than competitive apparatus. Still another advantage is that the apparatus is not vulnerable to rusting and other bleeding which would discolor the finished product.

In some embodiments of the invention the support may be molded as a single piece. Such embodiments will be understood to be equivalent to embodiments which have elements molded in discrete pieces.

The invention has been described with reference to its illustrated preferred embodiment. Persons skilled in the art of constructing plastic molding and/or reinforced concrete may, upon exposure to the teachings herein, conceive variations in the mechanical development of the components therein. Such variations are deemed to be encompassed by the disclosure, the invention being delimited only by the appended claims.

The inventor claims:

1. A support for use with an associated reinforcing rod, which is intended for reinforcement of concrete, which comprises:

first and second generally planar members;

said first member having a body portion, a first elongated leg and a second elongated leg, said first and second elongated legs thereof extending from said body portion in mutually diverging relationship, said body portion having an edge opposite to a side from which said first and second legs extend which is substantially rectilinear;

said second member having a body portion, a first elongated leg and a second elongated leg, said first and second elongated legs thereof extending from said body portion in mutually diverging relationship, said body portion having an edge opposite to a side from which said first and second legs extend which has upstanding extremities to constrain movement of an associated reinforcement rod; and means for engagement of said body portions of said first and second generally planar members for fixing them in substantially normal relationship, said means comprising a slot in each body portion.

2. The apparatus as described in claim 1, wherein:

said means comprises said slot in each body portion through which an imaginary plane extends which bisects an angle defined by the axes of said first and second elongated legs of such generally planar member.

3. The apparatus as described in claim 2, wherein:

one of said slots extends in one of said first and second body portions proximate to a point which is intermediate said elongated legs and proximate to the intersection of said elongated legs with said body portion.

4. The apparatus as described in claim 3, wherein:

one of said slots extends in one of said first and second generally planar members from the edge thereof remote from the side from which said elongated legs diverge.

5. The apparatus as described in claims 1, 2, 3, or 4, wherein:

said legs each include a rib extending along the inside edge thereof.

6. The apparatus as described in claim 5, wherein:

the axial extremity of each rib most remote from said body portion on any given member is spaced from the axial extremity of the associated leg which is most remote from said body portion.

7. The apparatus as described in claim 6, wherein:

at least one of said members includes additional ribs extending along the edges of said slot disposed therein.

8. The apparatus as described in claim 7, wherein:

said additional ribs extend from the top to the bottom of said body portion of said member on which they are disposed.

9. The apparatus as described in claim 8, wherein:

the distance intermediate the axial extremities of said legs of said second member, remote from said body portion is greater than the distance intermediate said upstanding extremities.

10. The apparatus as described in claim 9, wherein:

the distance intermediate the axial extremities of said legs of said first member, remote from said body portion is equal to the distance intermediate the axial extremities of said legs, of said second member.

11. The apparatus as described in claim 10, wherein:

said generally planar members are each manufactured of a plastic.

12. The apparatus as described in claim 11, wherein:

said plastic is gray.

* * * * *